US008939598B1

(12) United States Patent
Schmuckle

(10) Patent No.: US 8,939,598 B1
(45) Date of Patent: Jan. 27, 2015

(54) LANDSCAPE LIGHT FIXTURE WITH SLIDE AND LOCK MOUNTING BRACKET ASSEMBLY

(71) Applicant: Hunter Industries, Inc., San Marcos, CA (US)

(72) Inventor: Darrin I. Schmuckle, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 82 days.

(21) Appl. No.: 13/793,978

(22) Filed: Mar. 11, 2013

(51) Int. Cl.
*F21S 8/00* (2006.01)
*F21V 21/00* (2006.01)

(52) U.S. Cl.
CPC ..... *F21V 21/00* (2013.01)
USPC ..... 362/147; 362/370

(58) Field of Classification Search
CPC ..... F21S 8/036; F21S 8/081; F21S 8/033; F21V 21/08; F21V 21/088; F21W 2121/004; F21W 2131/107; F21W 2131/1005
USPC ..... 362/147, 152, 432, 368, 370; 248/220.21, 220.22
See application file for complete search history.

(56) References Cited

U.S. PATENT DOCUMENTS 5,136,493 A * 8/1992 Straus et al. ..... 362/373
5,349,134 A * 9/1994 Russell ..... 174/492
5,649,760 A 7/1997 Beadle
6,135,624 A * 10/2000 Masters et al. ..... 362/432
6,266,250 B1 * 7/2001 Foye ..... 361/760
6,357,892 B1 3/2002 Beadle
6,422,717 B1 7/2002 Beadle
6,443,783 B1 9/2002 Beadle
6,491,407 B1 12/2002 Beadle
6,497,592 B1 12/2002 Beadle
6,583,700 B1 6/2003 Beadle
6,612,720 B1 9/2003 Beadle
6,752,516 B1 6/2004 Beadle
6,779,907 B2 8/2004 Beadle
6,796,684 B1 9/2004 Beadle
6,799,869 B1 10/2004 Beadle
6,874,905 B1 4/2005 Beadle
6,902,200 B1 6/2005 Beadle
7,320,533 B1 1/2008 Beadle
7,387,409 B1 6/2008 Beadle
D573,297 S 7/2008 Beadle
7,614,769 B2 * 11/2009 Sell ..... 362/365
7,874,709 B1 1/2011 Beadle
7,993,040 B2 8/2011 Beadle
2001/0033487 A1 * 10/2001 Crelin ..... 362/147
2001/0048056 A1 * 12/2001 Gauci ..... 248/220.21
2004/0100787 A1 * 5/2004 Harris ..... 362/20
2004/0120141 A1 6/2004 Beadle
2009/0122564 A1 5/2009 Beadle
2012/0250337 A1 10/2012 Pike et al.
2012/0274219 A1 11/2012 Woytowitz et al.

* cited by examiner

*Primary Examiner* — Julie Bannan
(74) *Attorney, Agent, or Firm* — Knobbe Martens Olson & Bear LLP

(57) ABSTRACT

A light fixture includes a housing having a hollow interior and an open end. A circuit board is mounted in the hollow interior of the housing. A source of illumination is mounted on the circuit board. A light transferable cover extends across a lower end of the housing. A bracket assembly mounted to the housing includes a housing bracket and a mounting bracket that is configured for mating and subsequent relative sliding motion to releasably lock the housing bracket to the mounting bracket.

18 Claims, 6 Drawing Sheets

LANDSCAPE LIGHT FIXTURE WITH SLIDE AND LOCK MOUNTING BRACKET ASSEMBLY

FIELD OF THE INVENTION

The present invention relates to light fixtures, and more particularly, incandescent and LED light fixtures designed for installation on building structures and on other structures located around lawns and gardens of residential and commercial properties.

BACKGROUND OF THE INVENTION

Outdoor landscape lighting is popular for security, aesthetic, safety, and other reasons. For many years outdoor landscape light fixtures have incorporated incandescent light bulbs. Recent advances in light emitting diode (LED) technology have led to an increased demand for improved landscape light fixtures that utilize more reliable and more energy efficient high intensity LEDs.

Various types of commercial landscape light fixtures are available to meet the particular needs of residential or commercial properties. These include path, down, deck, tree, spot, spread, and security light fixtures. Down light fixtures, also referred to as "downlighting" or "moonlighting", are outdoor landscape light fixtures that are designed to place the illuminating source above the target area. Down light fixtures can be used to illuminate specific garden elements for aesthetic appeal, or to illuminate pedestrian areas and large specific spaces for safety, security or recreational purposes.

In the past the mounting of outdoor landscape light fixtures on the sides of building structures such as dwelling sidewalls, patio trellis beams, and decorative posts has usually been accomplished using wood screws. Typically these light fixtures have utilized integral brackets making the mounting process tedious. Moreover, repair or replacement of such light fixtures has usually required detachment of the mounting brackets from the structures by removing the wood screws.

SUMMARY OF THE INVENTION

The present invention provides a light fixture suitable for installation on building structures and on other structures located around lawns and gardens of residential and commercial properties. The light fixture includes a housing having a hollow interior and an open end. A circuit board is mounted in the hollow interior of the housing. A source of illumination is mounted on the circuit board. A light transferable cover extends across a lower end of the housing. A bracket assembly mounted to the housing includes a housing bracket and a mounting bracket that is configured for mating and subsequent relative sliding motion to releasably lock the housing bracket to the mounting bracket.

DETAILED DESCRIPTION

Figure 1:
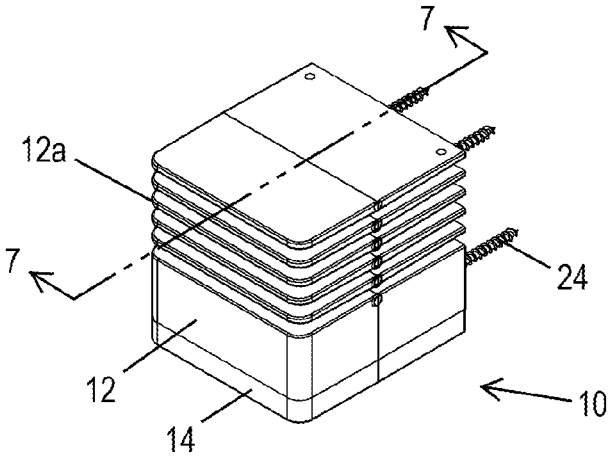
FIG. 1 is an isometric view of a light fixture in accordance with an embodiment of the present invention.
Figure 7:
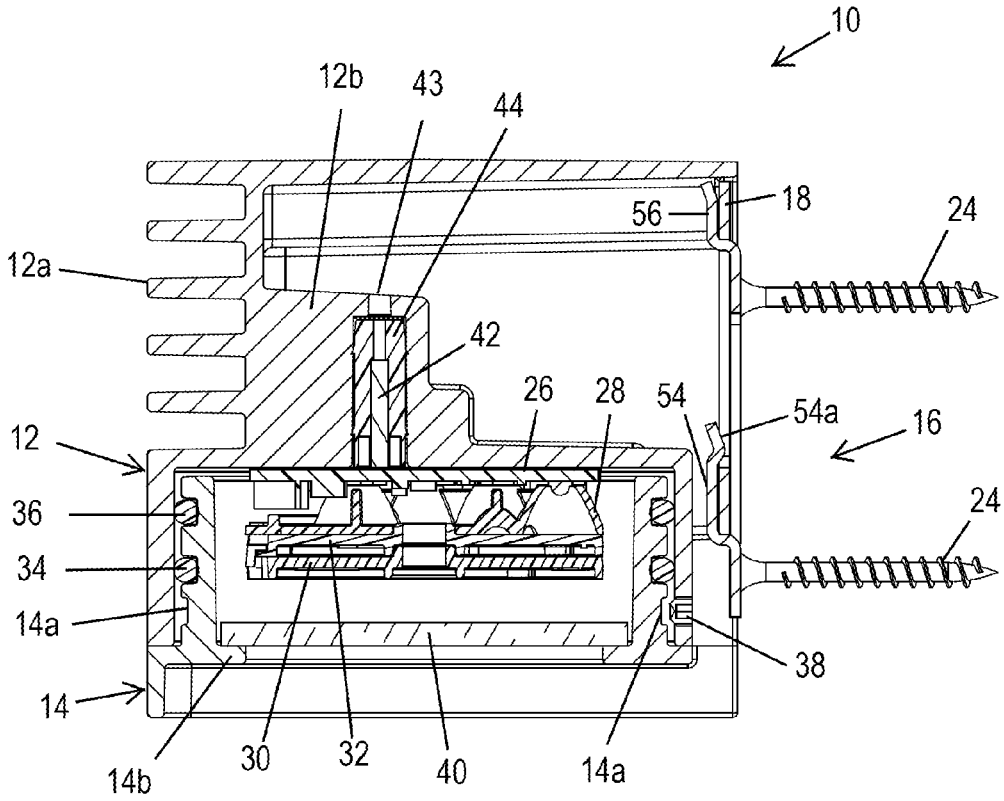
FIG. 7 is an enlarged vertical cross-section view of the light of FIG. 1 taken along line 7-7 of FIG. 1.
Figure 8:
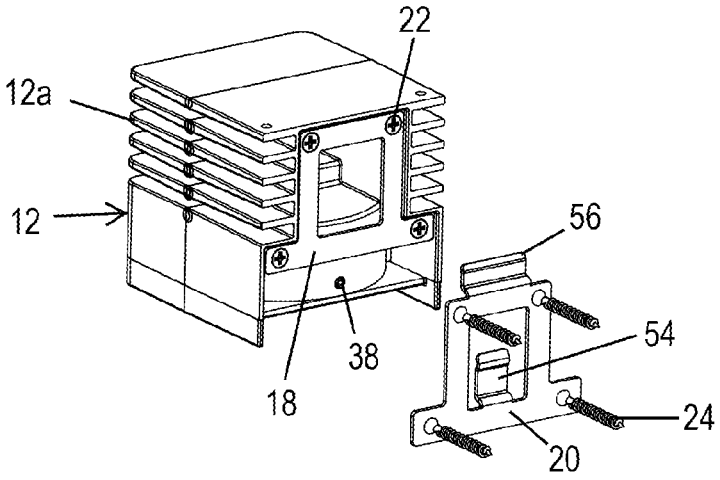
FIGS. 8-10 are a sequence of rear isometric views illustrating the slide and lock connection of the housing bracket secured to the rear of the light fixture to the mounting bracket which is normally screwed to a wooden building structure.

FIG. 1 illustrates a light fixture 10 in accordance with an embodiment of the present invention. The light fixture 10 includes a generally rectangular housing 12 (FIG. 7) defining a hollow interior that encloses electrical components. A generally rectangular shroud 14 is slip fit inside a lower portion of the housing 12. The shroud 14 directs and confines the emitted light. A mounting bracket assembly 16 is attached to a rear side of the exterior of the housing 12. The mounting bracket assembly 16 includes a housing bracket 18 (FIGS. 17-21) and a mounting bracket 20 (FIGS. 11-16). The housing bracket 18 is secured to the rear side of the housing 12 by four screws 22 (FIG. 8). Four wood screws 24 can be used to secure the mounting bracket 20 to the exterior of a house, a vertical post of a patio overhang, a stand-alone post, or another structure (not illustrated). The housing bracket 18 slides onto the front side of the mounting bracket 20 and releasably locks thereto to removably mount the light fixture 10 to the building structure.

Figure 2:
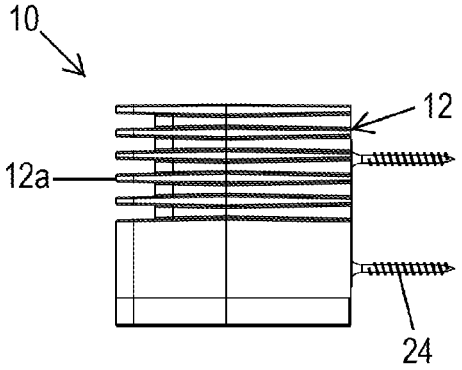
FIG. 2 is a side elevation view of the light fixture of FIG. 1 taken from the right side of FIG. 1.
Figure 3:
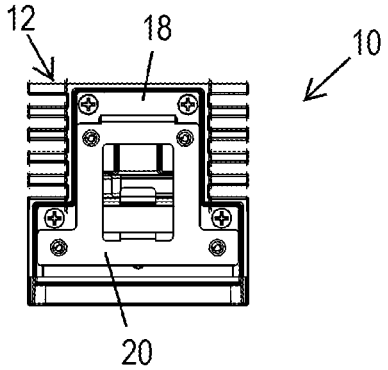
FIG. 3 is a rear elevation view of the light fixture of FIG. 1.
Figure 4:
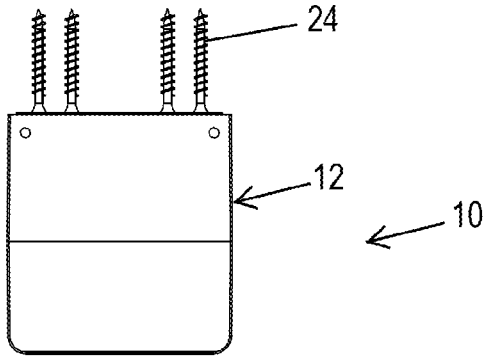
FIG. 4 is a top elevation view of the light fixture of FIG. 1.
Figure 5:
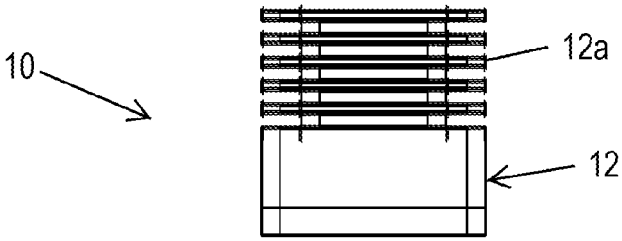
FIG. 5 is a front elevation view of the light fixture of FIG. 1.
Figure 6:
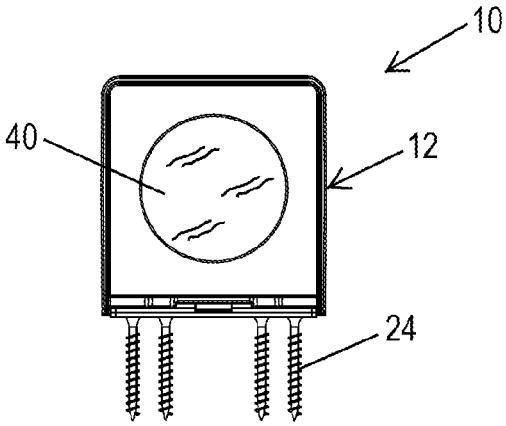
FIG. 6 is a bottom elevation view of the light fixture of FIG. 1.

The housing 12 and the lower shroud 14 are preferably machined from cast Aluminum alloy parts for aesthetic appeal, functionality and durability. An anodized or powder coating is preferably applied to the exterior of the machined Aluminum alloy parts to prevent oxidation and to provide an aesthetically appealing finish. These components can also me made of other suitable metals such as brass alloy, bronze alloy, Copper, etc. Some or all of them can be molded out of suitable plastic; however, a material with high thermal conductivity is preferred for the housing body 12 so that this component can facilitate the dissipation of the substantial heat generated by the plurality of LEDs. As illustrated in FIGS. 1, 2 and 7) the exterior of the upper portion of the housing 12 is formed with an integral heat sink in the form of a plurality of vertically spaced-apart ribs 12*a*.

Referring to FIG. 7, a luminary printed circuit board (PCB) 26 is mounted inside the housing 12. The luminary PCB 26 supports a plurality of high intensity LEDs (not visible) and on-board electronic circuitry, and also provides a conductive path to the electrical power. The LEDs are each surrounded by a corresponding parabolic reflector 28. Each parabolic reflector 28 surrounds an LED so that the LED is located at the approximate focus of the reflector 28. The reflectors 28 gather light emitted by the plurality of LEDs and forwardly directs the light in a predetermined desired pattern to the target area.

The luminary PCB 26 is preferably removably and replaceable in the event of a failure of the LEDs or any of the electronic circuitry on the PCB 26. The light fixture 10 may be of the intelligent LED type disclosed in U.S. patent application Ser. No. 12/564,840 filed Sep. 22, 2009 by Peter J. Woytowitz entitled "Low Voltage Outdoor Lighting Power Source and Control System" and published Apr. 8, 2010 under Publication No. US2010-0084985-A1, or U.S. patent application Ser. No. 13/244,869 filed Sep. 26, 2011 by Peter J. Woytowitz entitled "Systems and Methods for Providing Power and Data to Lighting Devices", now U.S. Pat. No. 8,278,845 granted Oct. 2, 2012, the entire disclosures of which are hereby incorporated by reference. Said applications and patent are assigned to Hunter Industries, Inc., the assignee of the subject application.

The light fixture 10 can have red, green and blue LEDs and can be connected to the aforementioned power source and control system in order to generate different lighting effects such as variable color and intensity in a reliable and energy efficient manner. The light fixture 10 could have an alternate source of illumination in the form of a single incandescent light and either a light bulb socket and/or a PCB formed with a simple layout of electrically conductive paths for power connection and without any electronic components.

Referring still to FIG. 7, the luminary PCB 26 supports a color filter 30 and a diffuser 32 that are mounted beneath the reflectors 28. The diffuser 32 softens the intensity of the light emitted by the LEDs as perceived by an observer's naked eye. The diffuser 32 also helps to blend different colored LED's to emit a more uniform single blended color.

The shroud 14 removably slips inside the lower portion of the housing 12. The male-to-female overlap of the lower portion of the housing 12 with the shroud 14 helps prevent entry of water into the lower portion of the housing 12 to protect the PCB 26 from external moisture. Additionally, entry of moisture into the lower portion of the housing 12 is further impeded by a pair of seals 34 and 36 (FIG. 7) made of a suitable elastomeric material that are seated in annular grooves formed in the exterior of the shroud 14 and are squeezed between the shroud 14 and the lower portion of the housing 12. A set screw 38 is threaded into a threaded hole that is formed in the lower portion of the housing 12 and is tightened against an annular groove 14*a* formed on the outer surface of the shroud 14 to securely hold the shroud 14 in position within the lower portion of the housing 12.

A protective light transferrable cover 40 extends across the lower end of the shroud 14 and provides an optical path for light to leave the light fixture 10. By way of example, the cover 40 can be made of glass, high temperature resistant plastic or scratch resistant sapphire. The cover 40 may be clear or translucent. The cover 40 may diffuse the lite being emitted from the light source. The cover 40 may be formed as a lens to direct light in a particular pattern. A lower periphery of the cover 40 engages the interior of an inwardly projecting horizontal flange 14*b* of the shroud 14.

The luminary PCB 26 (FIG. 7) has a pair of conductive male pins 42 made of metal that mate with corresponding metal contacts of a female electrical socket 44. The socket 44 is mounted in a transverse wall portion 12*b* of the upper portion of the housing 12. The socket is operatively connected to the distal end of a wire or cable (not illustrated) which can be routed though hole a 43 to a source of power (not illustrated). The hole 43 and area surrounding the socket 44 may be potted with an appropriate sealant to prevent moisture from entering the area around the socket 44.

Details of the housing bracket 18 and the mounting bracket 20 and their cooperation will now be described. Preferably they are both stamped from suitable metal. Referring to FIGS. 17-21, the housing bracket 18 has a generally T-shaped planar configuration that includes a square portion 18*a* and a pair of arms 18*b*. The square portion 18*a* is formed with a central rectangular aperture or cavity 18*c*. Two countersunk holes 46 formed in the square portion 18*a* and two countersunk holes 48 formed in the arms 18*b* receive the four screws 22 (FIG. 8) that secure the housing bracket 18 to the housing 12. Referring to FIGS. 11-16 the mounting bracket 20 also has a generally T-shaped planar configuration and is similar in size to housing bracket 18. The mounting bracket 20 includes a square portion 20*a* and a pair of arms 20*b*. Two countersunk holes 50 formed in the square portion 20*a* and two countersunk holes 52 formed in the arms 20*b* receive the four wood screws 24 (FIG. 8) that secure the mounting bracket 20 to a wooden building structure (not illustrated). The mounting bracket 20 is formed with a resilient locking tab 54 that projects into a central aperture or cavity 20*c* of the mounting bracket 20. The mounting bracket 20 is also formed with a resilient retaining tab 56 that extends away from the square portion 20*a* of the mounting bracket 20.

Figure 9:
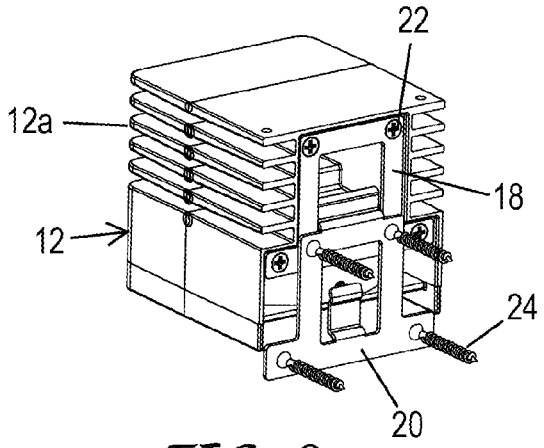
Figure 10:
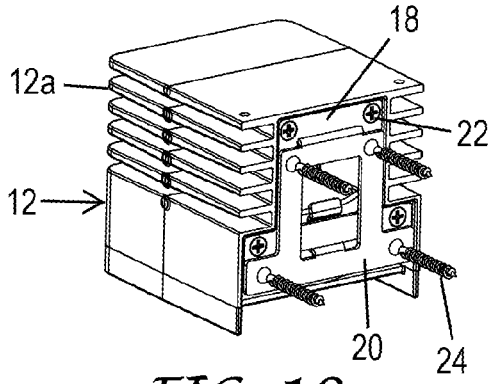
Figure 12:
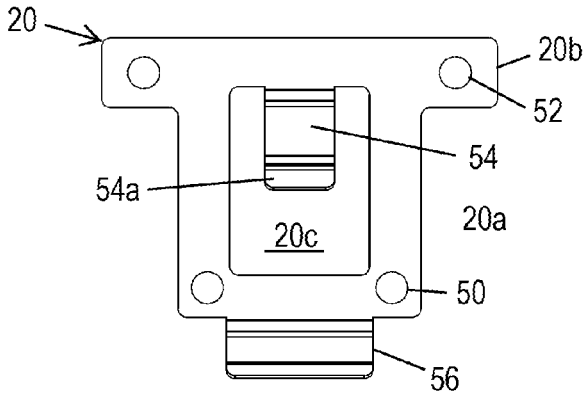
FIG. 12 is a rear elevation view of the mounting bracket.
Figure 11:
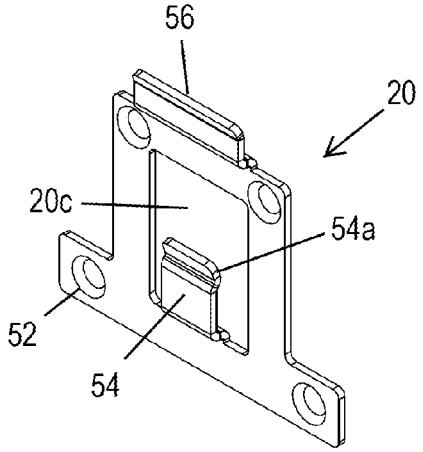
FIG. 11 is an isometric view of the mounting bracket taken from the front side thereof.
Figure 13:
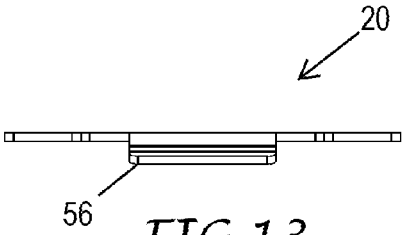
FIG. 13 is a bottom elevation view of the mounting bracket taken from the bottom of FIG. 12.
Figure 14:
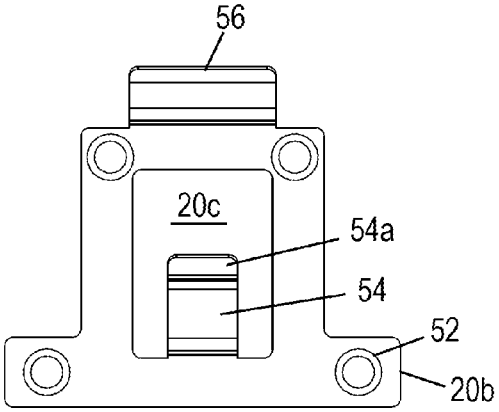
FIG. 14 is a front elevation view of the mounting bracket after being rotated one hundred and eighty degrees from the orientation illustrated in FIG. 12.
Figure 15:
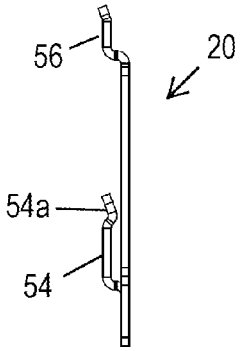
FIG. 15 is a side elevation view of the mounting bracket taken from the right side of FIG. 14.
Figure 16:
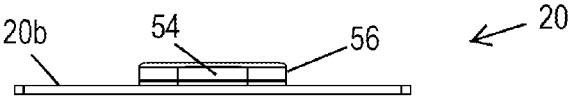
FIG. 16 is a bottom elevation view of the mounting bracket taken from the bottom of FIG. 14.
Figure 18:
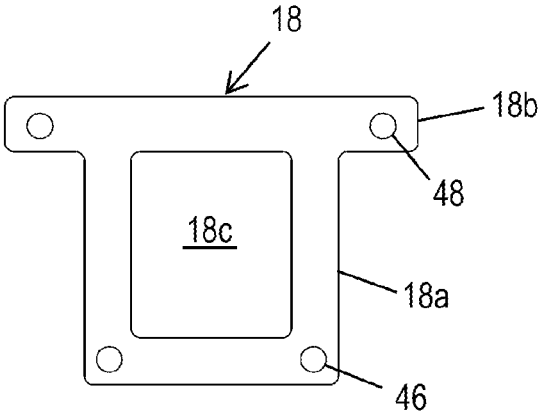
FIG. 18 is a front elevation view of the housing bracket.
Figure 19:
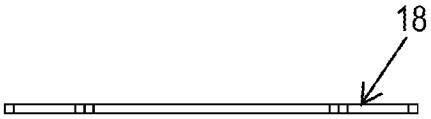
FIG. 19 is a bottom elevation view of the housing bracket taken from the bottom of FIG. 18.
Figure 17:
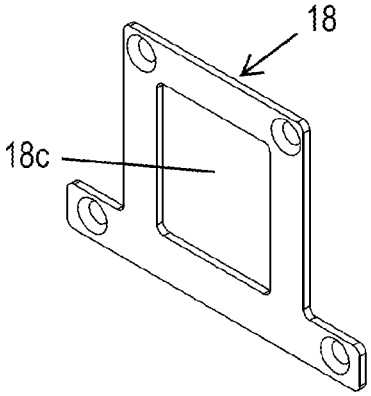
FIG. 17 is an isometric view of the housing bracket taken from the front side thereof.
Figure 20:
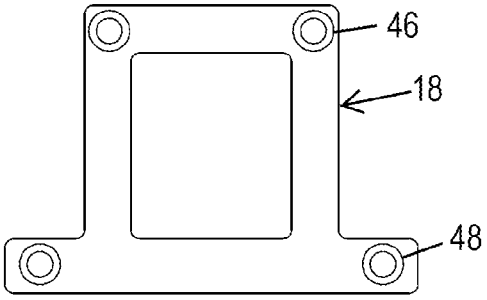
FIG. 20 is a rear elevation view of the housing bracket after being rotated one hundred and eighty degrees from the orientation illustrated in FIG. 12.
Figure 21:
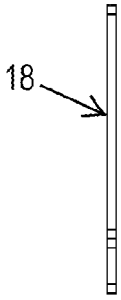
FIG. 21 is a side elevation view of the housing bracket taken from the right side of FIG. 20.

FIGS. 8-10 illustrate the slide and lock connection of the housing bracket 18 that is secured to the rear of the housing to the mounting bracket 20 that is first secured to a wooden building structure with wood screws 24. The mounting bracket assembly 16 is configured to allow mating engagement of its housing bracket 18 and mounting bracket 20 in overlapping fashion and subsequent linear sliding motion that releasably locks them together. An installer first holds the housing 12 of the light fixture 10 in front of the mounting bracket 20 as illustrated in FIG. 8. Next, as illustrated in FIG. 9, the installer then mates the lower portion of the housing bracket 18 with the upper portion of the mounting bracket 20 so that the retaining tab 56 is located in the cavity 18*c* of the housing bracket 18 and the locking tab 54 is below the square portion 18*a* of the housing bracket 18. Next, as illustrated in FIG. 10, the installer pulls down on the housing 12 of the light fixture 10 and slides the housing bracket 18 down over the mounting bracket 20. As best seen in FIG. 7, the retaining tab 56 is formed inwardly toward the housing 12 to allow the passage of the upper portion of the housing bracket 18. At the same time the locking tab 54 deflects inwardly to allow the passage of the lower portion of the housing bracket 18. The resilient locking tab 54 is dimensioned and configured with a bent distal segment 54*a* that springs back outwardly away from the housing 12 to engage an upper edge of a lower portion of the housing bracket 18. This releasably locks the housing bracket 18 to the mounting bracket 20. The distal segment 54*a* of the locking tab 54 engages the side edge of the edge of the housing bracket 18 after the housing bracket 18 has moved a predetermined distance relative to the mounting bracket 20 in order to allow the locking tab 54 to spring back outwardly away from the housing 20 to thereby releasably lock the housing bracket 18 to the mounting bracket 20. The retaining tab 56 confines the upper portion of the housing bracket 18 and helps releasably lock the housing bracket 18 to the mounting bracket 20.

The light fixture 10 is typically mounted in the orientation illustrated in FIG. 7 so that it functions as a down light. The light fixture 10 can be removed for repair or replacement by forcibly sliding the housing 12 upwardly to disengage the housing bracket 18 from the mounting bracket 20. When the installer forcibly slides the housing 12 upwards, the lower segment of the bracket 18 causes the distal segment 54*a* of the locking tab 54 to deflect inwardly toward the housing 12 to disengage the housing bracket 18 from the mounting bracket 20.

While an embodiment of a down light fixture has been described in detail, it will be understood by those skilled in the art, based on the description herein, that the present invention can be modified in both arrangement and detail. For example, only one LED could be installed on the PCB 26. The source of illumination could be an incandescent bulb instead of an LED. See U.S. Pat. No. 6,784,905 granted Apr. 5, 2005 to Joshua Z. Beadle or U.S. Pat. No. 7,387,409 granted Jun. 17, 2008 to Joshua Z. Beadle, the entire disclosures of which are hereby incorporated by reference. Said patents are also assigned to Hunter Industries, Inc. The light fixture 10 could be designed to work with the lighting controller disclosed in pending U.S. patent application Ser. No. 13/189,718 filed on Jul. 25, 2011 by Peter J. Woytowitz entitled "Programmable Landscape Lighting Controller with Self-Diagnostic Capabilities and Fail Safe Features", the entire disclosure of which is hereby incorporated by reference. Said application is also assigned to Hunter Industries, Inc. The upper portion of the housing 12 and its shroud 14 could be formed as a single integral housing instead of two pieces. Alternatively, the shroud 14 could be formed to attach to the bottom off the housing 12 without extending in to a portion of the housing 12. The retaining tab 56 could be formed to contact the bracket 18 and deflect inwardly as upper part of the bracket 18 slides past it so the spring force of the retaining tab 56 pushes against the inner surface of the upper portion of the housing bracket 18. The housing bracket 18 could be integrally formed with the housing 12. The features and functions of the housing bracket 18 and mounting bracket 20 could be reversed, i.e. the features of the mounting bracket 20 could be part of the housing 12 and the features of housing bracket 18 could be changed so that it could secured to the building structure and still allow slide and lock mating with the mounting bracket 20. Therefore, the protection afforded the present invention should only be limited in accordance with the scope of the following claims.

What is claimed is:

1. A light fixture for installation on building structures and on other structures located around lawns and gardens of residential and commercial properties, comprising:

a housing having a hollow interior and an open end;

a circuit board mounted in the hollow interior of the housing;

a source of illumination mounted on the circuit board;

a clear or translucent cover that extends across a lower end of the housing; and a bracket assembly mounted to the housing including a housing bracket and a mounting bracket configured for mating and subsequent relative sliding motion to releasably lock the housing bracket to the mounting bracket;

wherein the mounting bracket includes a resilient locking tab configured to deflect to allow passage of a portion of the housing bracket; and wherein the locking tab has a distal segment that engages an edge of the portion of the housing bracket after the portion of the housing bracket has moved a predetermined distance to allow the locking tab to spring back to releasably lock the housing bracket to the mounting bracket.

2. The light fixture of claim 1 wherein the housing bracket is secured to the housing.

3. The light fixture of claim 2 the mounting bracket has a plurality of holes for receiving screws that secure the mounting bracket to a building structure.

4. The light fixture of claim 1 and further comprising a shroud that is attached to a portion of the housing.

5. The light fixture of claim 4 wherein at least one seal is positioned between the portion of the housing and the shroud to prevent water from traveling into the interior of the housing.

6. The light fixture of claim 1 wherein the locking tab is configured to deflect when it engages a portion of the housing bracket.

7. The light fixture of claim 1 wherein the mounting bracket includes a retaining tab that is configured to confine a second portion of the housing bracket.

8. The light fixture of claim 1 wherein the locking tab is configured to deflect when it engages a first portion of the housing bracket and wherein the mounting bracket includes a retaining tab that is configured to confine a second portion of the housing bracket.

9. The light fixture of claim 1 wherein the source of illumination includes at least one LED, and the light fixture further comprises a filter and a diffuser mounted in the housing that extend across a path of illumination of the LED.

10. A light fixture, comprising:

a housing having a generally rectangular shape, a hollow interior and an open end;

a source of illumination mounted in the housing;

a clear or translucent cover that extends across a lower end of the housing; and a bracket assembly mounted to the housing including a housing bracket having a generally planar rectangular configuration and mounted to a rear side of the housing and a mounting bracket configured to be secured to a building structure, the housing bracket and the mounting bracket being configured for mating and subsequent relative linear sliding motion to releasably lock the housing bracket to the mounting bracket;

wherein the mounting bracket has a generally planar configuration so that it can overlap and slide relative to the housing bracket, the mounting bracket including a resilient locking tab configured to deflect to allow passage of a portion of the housing bracket, and wherein the locking tab has a distal segment that engages an edge of the portion of the housing bracket after the portion of the housing bracket has moved a predetermined distance to allow the locking tab to spring back to releasably lock the housing bracket to the mounting bracket.

11. The light fixture of claim 10 and further comprising a circuit board mounted within the housing, and where in the source of illumination includes at least one LED mounted on the circuit board.

12. The light fixture of claim 11 and further comprising a shroud that is slip fit into a portion of the housing.

13. The light fixture of claim 11 and further comprising a diffuser mounted in the housing that extends across a path of illumination of the LED.

14. The light fixture of claim 10 wherein the mounting bracket includes a retaining tab that allows passage of a second portion of the housing bracket.

15. A light fixture for installation on building structures and on other structures located around lawns and gardens of residential and commercial properties, comprising:

a housing having a hollow interior and an opening formed in one end thereof;

a source of illumination mounted within the housing;

a transparent cover extending across the opening in the end of the housing; and a bracket assembly mounted to the housing, the bracket assembly including a housing bracket mounted to an exterior of the housing and a mounting bracket configured to be secured to a building structure, the housing bracket and the mounting bracket being configured for mating engagement and subsequent relative linear sliding motion to releasably lock the housing bracket to the mounting bracket, the housing bracket having a generally planar rectangular configuration and being mounted to a rear side of the housing, the mounting bracket having a generally planar configuration so that it can overlap and slide relative to the housing bracket, the mounting bracket including a resilient locking tab configured to deflect to allow passage of a first portion of the housing bracket, the locking tab having a distal segment that engages an edge of the first portion of the housing bracket after the portion of the housing bracket has moved a predetermined distance to allow the locking tab to spring back to releasably lock the housing bracket to the mounting bracket, the mounting bracket including a retaining tab that allows passage of a second portion of the housing bracket and retains the second portion of the mounting bracket.

16. The light fixture of claim 10 wherein the mounting bracket has a plurality of holes for receiving screws that secure the mounting bracket to a building structure.

17. The light fixture of claim 10 wherein the mounting bracket includes a retaining tab that is configured to confine a portion of the housing bracket.

18. The light fixture of claim 12, wherein at least one seal is positioned between the portion of the housing and the shroud to prevent water from travelling to the interior of the housing.

* * * * *